US005921544A

United States Patent [19]

Benedict

[11] Patent Number: 5,921,544

[45] Date of Patent: Jul. 13, 1999

[54] ACQUISITION LEVITATION TRANSPORT DEVICE

[75] Inventor: Lawrence R. Benedict, Rushville, N.Y.

[73] Assignee: Xerox Corporation, Stamford, Conn.

[21] Appl. No.: 08/565,457

[22] Filed: Nov. 30, 1995

[51] Int. Cl.[6] ..... B65H 9/00

[52] U.S. Cl. ..... 271/226; 271/276; 271/197; 271/265.02

[58] Field of Search ..... 271/12, 13, 15, 271/276, 226, 227, 196, 197, 265.02

[56] References Cited

U.S. PATENT DOCUMENTS

| | | | |
|---|---|---|---|
| 4,362,380 | 12/1982 | Dragstedt | 271/276 |
| 4,421,306 | 12/1983 | Muka | 271/276 |
| 4,763,160 | 8/1988 | Honjo | 271/227 |
| 4,997,178 | 3/1991 | Ogoda | 271/276 |
| 5,133,543 | 7/1992 | Eitel et al. | 271/276 |
| 5,219,159 | 6/1993 | Malachawski | 271/228 |

FOREIGN PATENT DOCUMENTS

| | | | |
|---|---|---|---|
| 0012450 | 1/1985 | Japan | 271/276 |
| 0221043 | 9/1990 | Japan | 271/276 |
| 404085234 | 3/1992 | Japan | 271/197 |
| 405278894 | 10/1993 | Japan | 271/197 |

*Primary Examiner*—H. Grant Skaggs
*Attorney, Agent, or Firm*—H. Fleischer; B. P. Smith

[57] ABSTRACT

An apparatus for advancing a sheet. The apparatus includes a transport which has the sheet releasably secured thereto in one mode of operation, and, in another mode of operation reduces the frictional force between the sheet and the transport to facilitate relative movement therebetween. A controller, in communication with the transport, selects the mode of operation of the transport.

6 Claims, 4 Drawing Sheets

ACQUISITION LEVITATION TRANSPORT DEVICE

This invention relates generally to transporting a moving sheet to a registration station so that a developed image on a moving surface is transferred thereto in registration.

In a typical electrophotographic printing process, a photoconductive member is electrostatically charged, and then exposed to a light pattern of an original image to selectively discharge the surface in accordance therewith. The resulting pattern of charged and discharged areas on the photoconductive member form an electrostatic charge pattern known as a latent image. The latent image is developed by contacting it with a dry or liquid developer material having a carrier and toner. The toner is attracted to the image areas and held thereon by the electrostatic charge on the photoconductive member. Thus, a toner image is produced in conformity with a light image of the original being reproduced. The toner image is transferred to a copy sheet, and the image affixed thereto to form a permanent record of the image to be reproduced. Subsequent to development, excess toner left on the photoconductive member is cleaned from its surface. The process is useful for light lens copying from an original document or for printing electronically generated or stored originals such as with a raster output scanner (ROS), where a charged surface may be imagewise discharged in a variety of ways.

The foregoing discussion generally describes a typical black and white or single color electrophotographic printing process. The approach utilized for multicolor electrophotographic printing is substantially identical. However, instead of forming a single latent image on the photoconductive member, multiple latent images corresponding to different color separations are sequentially developed thereon. Each single color latent image is developed with toner complimentary thereto. This process is repeated for each of the differently colored images with a respective toner of a complimentary color. Thereafter, each single color toner image is transferred to the copy sheet in superimposed registration with the prior toner image, creating a multi-layered toner image. This multi-layered toner image is permanently affixed to the copy sheet in a conventional manner to form a finished color copy.

In a printing machine of the foregoing type, sheet handling devices have incorporated some sort of transport to move a sheet to a registration area. Whether the sheet is a document, in a document handler, or a copy sheet, in a marking and imaging module, transporting the sheet to a registration area for alignment to a known orientation is necessary to achieve high quality copying on a wide variety of sheet sizes and beam strengths.

Heretofore, the most common type of registration transport used in electrophotographic printing has been an edge-type system. An edge-type system comprises a transport having rolls, or a ball and belt device which exerts a lateral force on the sheet so as to move it across the transport and position it against a registration edge. The edge is located on a side of the transport, parallel to the sheet's direction of travel to ensure correct lead edge to trail edge registration.

While edge registration is easy to implement, it suffers from the disadvantage of having to operate on a sensitive balancing of forces. For example, the drive force exerted on the sheet must always be greater than the sheet's drag force against the transport. At the same time, the drive force can not damage the sheet as it contacts the registration edge. Variables such as sheet friction, beam strength, nip force, contamination, temperature, and humidity effect the drive force and consequently limit the range of sheets that are transportable by an edge-type system.

Techniques for registering paper and registering images on photoconductive belts have hereinbefore been devised as illustrated by the following disclosure, which may be relevant to certain aspects of the present invention.

U.S. Pat. No. 5,219,159

Patentee: Malachowski et al.

Issued: Jun. 15, 1993

U.S. Pat. No. 5,219,159 discloses an active sheet registration system suitable for an electrophotographic printing machine. A sheet is driven forward towards a dual set of stalled registration rolls. When the sheet contacts one pair of registration rolls, it is detected by a first sensor which activates the rolls to move the sheet into the nips. The sheet moves until it's leading edge is aligned in both registration roll pairs. A second sensor, on the edge of the paper path, ensures proper registration for the sheet edge. A translating device laterally moves the registration rolls until the sheet is recognized by the second sensor.

In accordance with one aspect of the invention, there is provided an apparatus for advancing a sheet. The apparatus includes a transport. In one mode of operation, the transport has the sheet releasably secured thereto. In another mode of operation, the frictional force between the sheet and the transport is reduced to facilitate relative movement therebetween. A controller, in communication with the transport, selects the mode of operation of the transport.

In accordance with yet another aspect of the invention, there is provided a printing machine of the type having a sheet advancing to a transfer station for receiving a visible image from a recording medium. The improvement includes a stack of sheets, and a transport for advancing the stack of sheets to the transfer station. In one mode of operation, the transport has the sheet releasably secured thereto. In another mode of operation, the frictional force between the sheet and the transport is reduced to facilitate relative movement therebetween. A controller, in communication with the transport, selects the mode of operation of the transport.

In accordance with still another aspect of the invention, there is provided a printing machine of the type having a document advancing to an exposure station. The improvement includes a transport having the document releasably secured thereto in one mode of operation. In another mode of operation, the frictional force between the document and the transport is reduced to facilitate relative movement therebetween. A controller, in communication with the transport, selects the mode of operation of the transport.

While the present invention will hereinafter be described in connection with a preferred embodiment thereof, it will be understood that it is not intended to limit the invention to that embodiment. On the contrary, it is intended to cover all alternatives, modifications and equivalents that may be included within the spirit and scope of the invention as defined by the appended claims.

Figure 1:
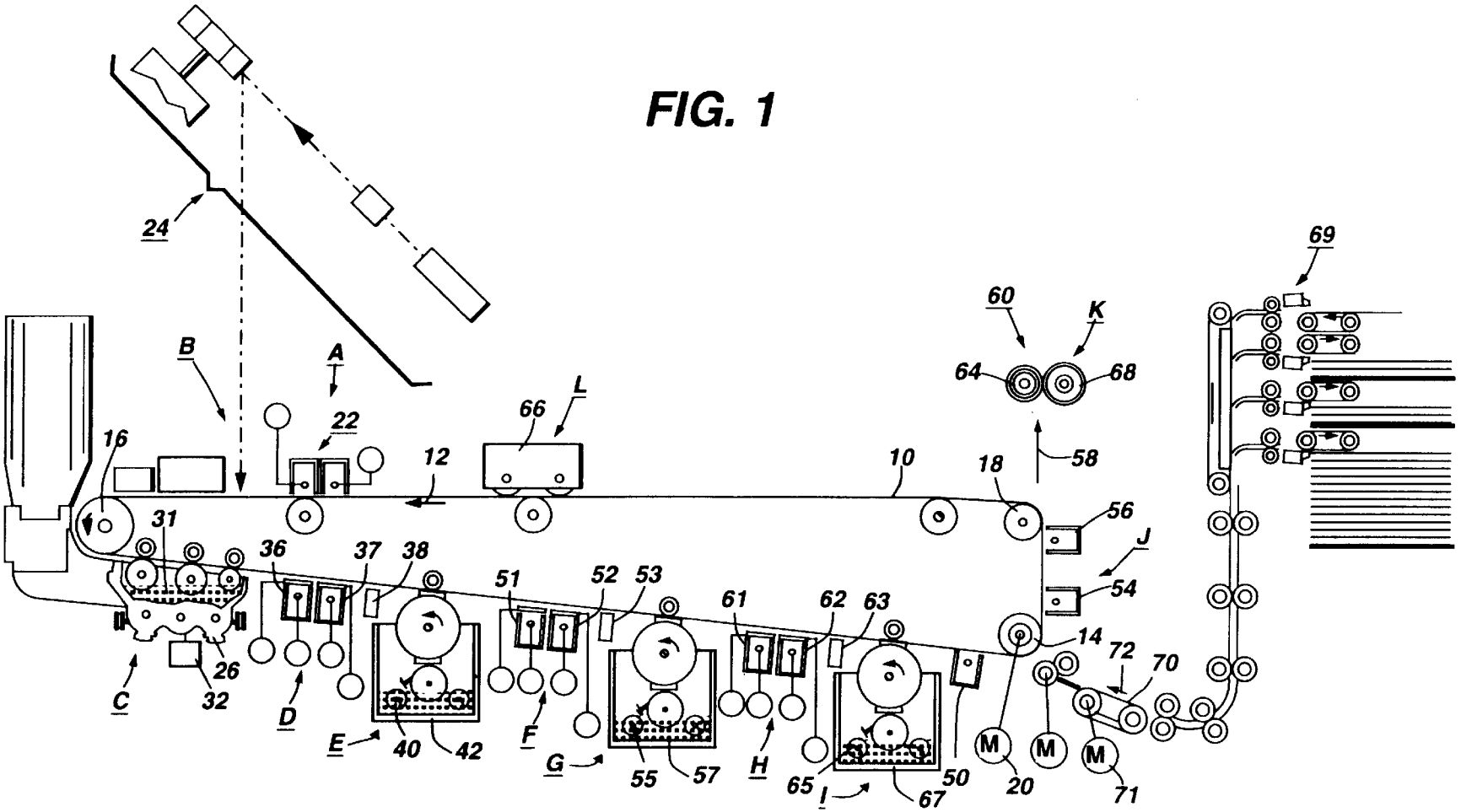
FIG. 1 is an elevational view of an illustrative printing machine incorporating the sheet transport of the present invention therein.

FIG. 1 schematically depicts the various elements of an illustrative color electrophotographic printing machine incorporating the sheet transport of the present invention therein. It will become evident from the following discussion that the acquisition levitation transport is equally well suited for use in a wide variety of printing machines and is not necessarily limited in its application to the particular embodiment depicted herein.

Turning now to FIG. 1, the printing machine employs a photoreceptor 10 in the form of a belt having a photoconductive surface layer on an electroconductive substrate. Photoreceptor 10 is driven by motor 20 and moves along a path indicated by arrow 12 around rollers 14, 18, and 16 as indicated by arrow 12.

Initially, photoreceptor 10 passes through charging station A where it is charged to a relatively high uniform potential by corona generating device 22. For purposes of this example, photoreceptor 10 is negatively charged. However, it is understood that a positively charged photoreceptor may be used by reversing the charge levels, toner polarities, and other relevant regions or devices involved in the color image formation process.

Next, the charged portion of photoreceptor 10 is advanced to an imaging station B where it is exposed by scanning device 24 and discharged to form a latent image in accordance with the output therefrom. Scanning device 24 is a Raster Output Scanner (ROS) that creates an image in a series of horizontal scan lines having a certain number of pixels per inch. It may include a laser with rotating polygon mirror blocks and a suitable modulator, or in lieu thereof, a light emitting diode array (LED) write bar. The ROS is controlled by the output from an electronic subsystem (ESS) which prepares and manages the image data flow between a computer and the ROS. The ESS is the control system for the ROS and may be a self-contained, dedicated minicomputer. Thereafter, the latent image on photoreceptor 10 is advanced to development station C.

One skilled in the art will appreciate that a light lens system may be used instead of the scanning system hereinbefore described. With a light lens system, an original document may be placed face down on a transparent platen. Lamps emit light rays that are reflected by the document and transmitted through a lens to form a light image thereof. The lens focuses the light image onto the charged portion of the photoreceptor to selectively dissipate the charge thereon. This records a latent image on the photoreceptor corresponding to the informational areas contained in the original document disposed on the platen. In a printing machine of this type, an original document may be advanced to the platen by the sheet transport of the present invention. Thus, the term sheet used hereinafter may be considered to be a sheet receiving an image at the transfer station of the printing machine, and a document advancing to the platen.

The latent image on photoreceptor 10 is advanced to a first development station C, where a magnetic brush developer unit 26 advances developer material 31 into contact with the latent image. Developer unit 26 has a plurality of magnetic brush roller members that transport negatively charged black toner material 31 to the latent image for development thereof. A power supply 32 electrically biases developer unit 26.

At recharging station D, a pair of corona recharge devices 36 and 37 are employed for adjusting the voltage level of both the toned and untoned areas on photoreceptor 10 to a uniform level. A power supply is coupled to each of the electrodes of corona recharge devices 36 and 37. Recharging devices 36 and 37 eliminate any voltage differences between toned and untoned areas. They also function to reduce the level of residual charge remaining on the previously toned areas, so that subsequent development of different color toner images is effected across a uniform development field.

Imaging device 38 records a second electrostatic latent image on photoreceptor 10. A negatively charged developer material 40, for example, yellow toner, develops the second latent image. The toner is contained in a developer unit 42 disposed at a second developer station E. A donor roll in developer housing 42 transports the toner to the second latent image. A power supply (not shown) electrically biases the developer unit.

At a second recharging station F, corona recharge devices 51 and 52 uniformly adjust the voltage level between the toned and untoned areas of photoreceptor 10. Recharging devices 51 and 52 also reduce the residual charge level remaining on the previously toned areas. In this manner, the subsequent development of a different color toner image is effected across a uniform development field.

A third latent image is recorded on photoreceptor 10 by imaging device 53. This image is developed using a third color toner 55 contained in a developer unit 57 disposed at a third developer station G. An example of a suitable third color toner is magenta. Suitable electrical biasing of the developer unit 57 is provided by a power supply, not shown.

At a third recharging station H, corona recharge devices 61 and 62 uniformly adjust the voltage level between the toned and untoned areas of photoreceptor 10. Recharging devices 61 and 62 also reduce the level of residual charge remaining on the previously toned areas. In this manner, the subsequent development of a different color toner image is effected across a uniform development field.

A fourth latent image is recorded on photoreceptor 10 by imaging device 63. This image is developed, for example, using a cyan color toner 65 contained in developer unit 67 at a fourth developer station I. Suitable electrical biasing of the developer unit 67 is provided by a power supply (not shown).

Developer units 42, 57, and 67 are preferably of the type which do not interact, or are only marginally interactive with previously developed images. Examples include: a DC jumping development system, a powder cloud development system, and a sparse, non-contacting magnetic brush development system. Each example is suitable for use in an image on image color development system.

After development of the fourth latent image, a pretransfer corotron member 50 conditions the toner for effective transfer to a copy sheet. Pretransfer corotron 50 negatively charges all toner particles to a negative polarity required for proper transfer.

A sheet feeding apparatus 69 operates to advance a copy sheet from a selected tray. The sheet moves along a sheet path to the sheet transport of the present invention, which is generally indicated by the reference number 70. The sheet transport 70 is driven by a motor 71, in the direction of arrow 72, to move the copy sheet to registration station M. At registration station M, the copy sheet is laterally registered and deskewed before it arrives at transfer station J in synchronization with the toner image on the surface of photoreceptor 10. Sheet registration of the type accomplished at registration station M is described in U.S. Pat. No. 5,219,159 issued to Malachowski et al. in June, 1993, the relevant portions thereof being incorporated into the present invention.

Transfer Station J includes a transfer corona device 54 which sprays positive ions onto the backside of the copy sheet. This attracts the negatively charged toner powder images from photoreceptor belt 10 to the sheet. A detack corona generator 56 is provided to strip the sheet from belt 10.

After transfer, the sheet continues to move, in the direction of arrow 58, to a conveyor (not shown) which advances the sheet to fusing station K. Fusing station K includes a fuser assembly 60 which permanently fixes the transferred color image to the copy sheet. Preferably, fuser assembly 60 comprises a heated fuser roller 64 and a backup or pressure roller 68. The copy sheet passes between fuser roller 64 and backup roller 68 with the toner powder image contacting fuser roller 64. In this manner, the toner powder images are permanently fixed to the sheet. After fusing, a chute (not shown) guides the advancing sheet to a finishing module (not shown).

After the copy sheet is separated from photoreceptor 10, the residual toner carried on the photoreceptor surface is removed therefrom. The toner is removed at cleaning station L using a cleaning brush structure contained in a housing 66.

FIG. 1 illustrates an example of a printing machine having the sheet transport of the present invention therein to produce a visible image on image color output in a single pass or rotation of the photoreceptor. However, it is understood that the sheet transport of the present invention may be used in a multiple pass color image formation process. In a multiple pass system, each successive color image is applied in a subsequent pass or rotation of the photoreceptor. A single corona generator is used to charge the photoreceptor surface prior to each subsequent color image formation. With this alternative, only a single exposure device is needed to expose the photoreceptor prior to each color image development. The cleaning station must be capable of moving away from the photoreceptor surface during the image formation process, so that the image is not disturbed prior to image transfer.

Figure 3:
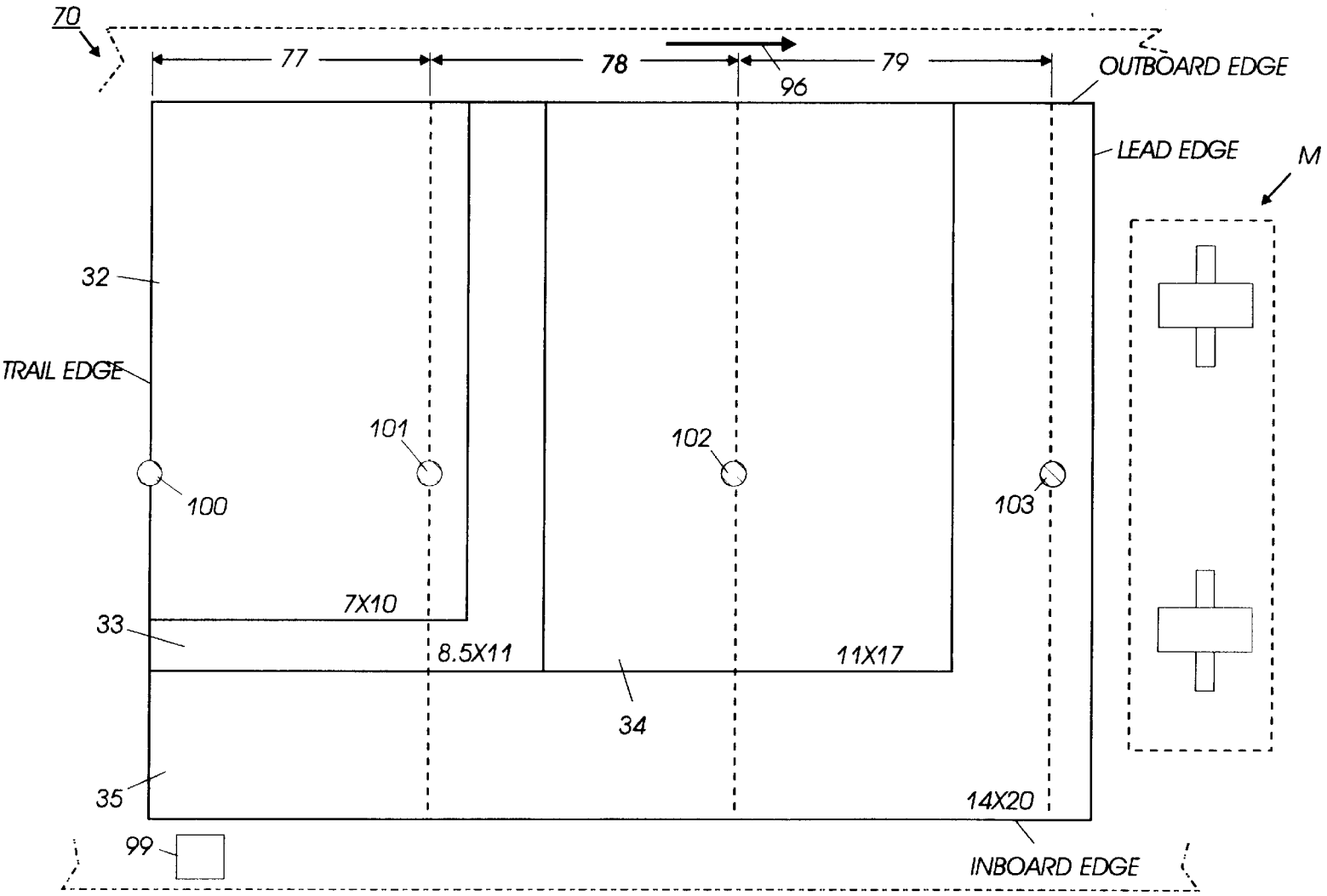
FIG. 3 is a plan view of the sheet transport showing a plurality of sensors and sheets positioned thereon.
Figure 4:
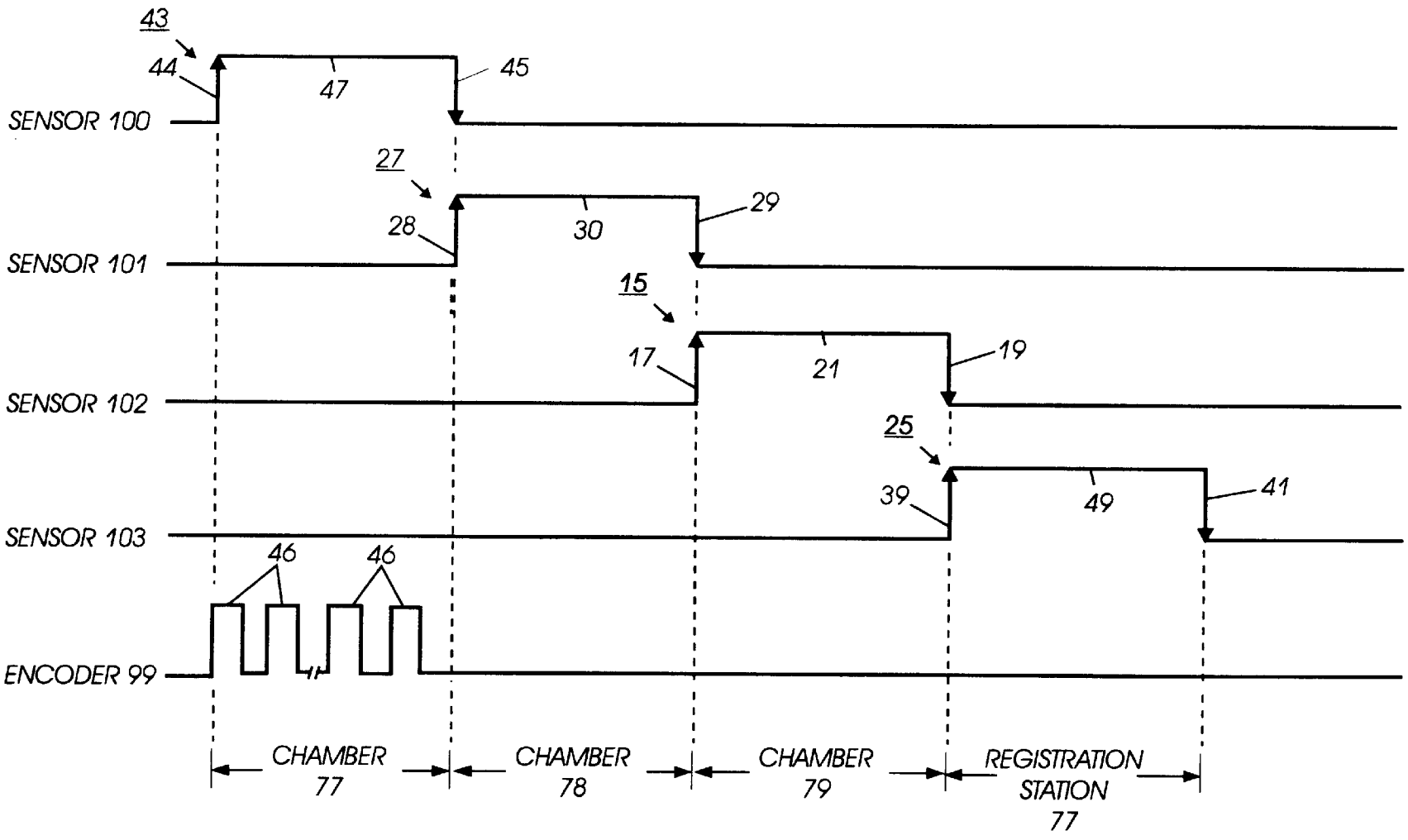
FIG. 4 is an exemplary diagram for the sheet transport illustrating the timing relationship the sensors and encoder.

It is believed that the foregoing description is sufficient to illustrate the general operation of an electrophotographic printing machine. Referring now to the specific subject matter of the present invention, FIGS. 2 through 4 illustrate the structure and operation of the sheet transport in greater detail.

Figure 2:
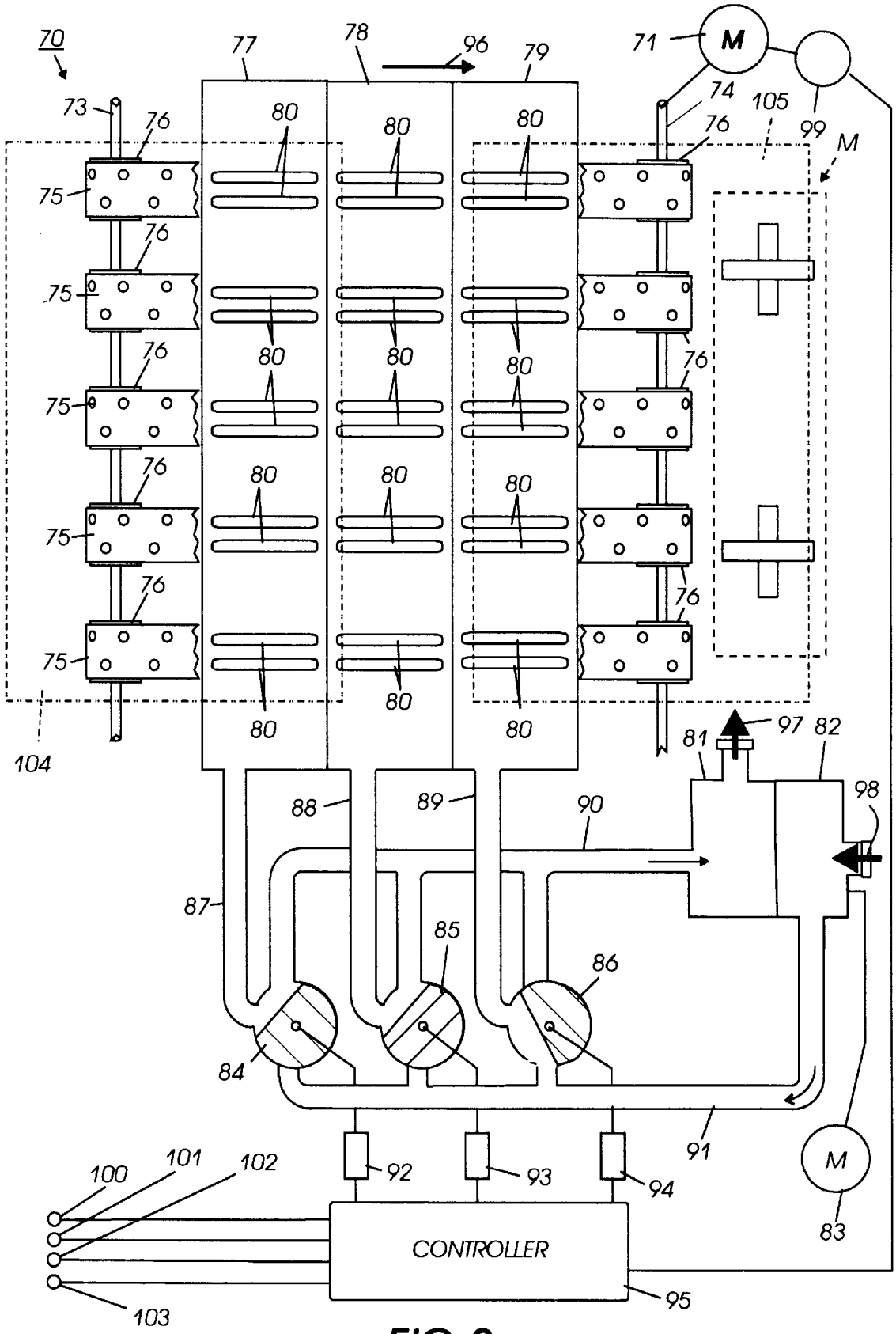
FIG. 2 is a schematic view of the sheet transport used in the FIG. 1 printing machine present invention.

Turning now to FIG. 2, there is shown a schematic representation of the present invention. It can be seen from FIG. 2 that the sheet transport 70 is comprised of a plurality of perforated elastomer belts 75 which are strung between two parallel shafts 73 and 74. Shaft 74 functions as a drive shaft driven by a motor 71 to rotate belts 75 in the process direction indicated by arrow 96. Belts 75 ride on pairs of crowned or flanged rolls 76. Directly under belts 75 is a series of independent, pneumatically sealed chambers 77, 78, and 79 having slots 80 therein. Each chamber 77, 78, and 79 is connected to a pair of parallel blowers 81 and 82 through a separate two-way valve. Specifically, chamber 77 is connected to valve 84 via an airline 87. Chamber 78 is connected to valve 85 by airline 88 and chamber 79 is connected to valve 86 by airline 89. A common exhaust line 90 joins the output ports of valves 84, 85, and 86 to blower 81. Similarly, a common inlet line 91 joins the input ports of valves 84, 85, and 86 to blower 82. Blowers 81 and 82 are driven by a common motor 83. Blower 81 exhausts air to the environment in the direction of arrow 97 and blower 82 sources air from the environment as indicated by arrow 98. Hence, blower 81 provides a vacuum and blower 82 provides pressure.

One skilled in the art will appreciate that a single blower may be used to provide the functions of blowers 81 and 82. Likewise, a single, wide belt may replace belts 75.

Continuing with FIG. 2, each valve 84, 85, and 86, for example, is connected to an operative device such as a respective solenoid 92, 93, and 94. Solenoids 92, 93, and 94 are further connected as output devices to a controller 95. Controller 95 operates the valves as sheets moves across transport 70 towards registration station M. As sheets move (in the process direction of arrow 96), solenoids 92, 93, and 94 are actuated by controller 95 causing valves 84, 85, and 86 to alternate between two states: acquisition and levitation. In the acquisition state, the valve input ports are closed and the output ports are opened. The acquisition state forces the sheet against transport 70 using blower 81. Air is pulled through the perforations in belts 75 and the corresponding chamber slots 80 to the common exhaust line 90. Conversely, in the levitation state, the valve input ports are opened and the output ports are closed. The levitation state lifts the sheet from transport 70 using blower 82. Air is pushed through the common inlet line 91 to the corresponding chamber and out it's slots 80 to the perforations in belts 75.

One skilled in the art will appreciate that the function of the solenoids can be accomplished with other devices such as, for example, stepper motors and mechanical cams.

Valves 84, 85, and 86 are dependent upon the sheet size and it's position on transport 70. Valve timing is achieved with a plurality of input devices connected to controller 95. The input devices comprise sensors 100, 101, 102, 103, and encoder 99. Encoder 99 is attached to the shaft of motor 71 and may, for example, generate a 100 pulses per revolution. Sensors 100 through 103 are opto-electrical sensors which are positioned along path of transport 70 to detect the lead and trail edges of the sheets thereon.

In FIG. 2, valves 84 and 85 are shown in the acquisition state while valve 86 is in the levitation state. A first sheet 104 is shown moving onto transport 70. The leading edge of sheet 104 triggers sensor 100 and signals controller 95 to measure the sheet length by counting pulses from encoder 99. The triggering of sensor 100 also causes controller 95 to activate solenoid 92. Solenoid 92 engages valve 84 and places chamber 77 in the acquisition state. The acquisition state of chamber 77 applies a drive force on sheet 104 to move it across the portion of transport 70 defined by chamber 77. The drive force is derived by valve 84 closing off the common inlet line 91 to air line 87 and opening a passage way to the common exhaust line 90. In this manner sheet 104 is tacked to belts 75. When sheet 104 advances to chamber 78 (not shown), sensor 100 detects it's trailing edge. The trailing edge of sheet 104 signals controller 95 to cease measuring the sheet's length. Solenoid 92 and valve 84 remain engaged by controller 95 to keep chamber 77 in the acquisition state. The leading edge of sheet 104 triggers sensor 101 and controller 95 activates solenoid 93. Solenoid 93 engages valve 85 and places chamber 78 in the acquisition state. The acquisition state of chamber 78 also applies a drive force to sheet 104 to move it across that portion of transport 70. The drive force, at chamber 78, is derived by valve 85 closing off the common inlet line 91 to air line 88 and opening a passage way to the common exhaust line 90. Consequently, sheet 104 remains tacked to belts 75 over chambers 78.

FIG. 2 also shows a second sheet 105 being delivered to registration station M. The lead edge of sheet 105 triggers sensor 103 and the trail edge triggers sensor 102. Sensor 103 signals controller 95 to release solenoid 94 and disengage valve 86. Valve 86 switches chamber 79 to the levitation state. The levitation state, at chamber 79, provides a low drag surface on which sheet 104 can ride so that it can be easily deskewed and laterally shifted at registration station M. The low drag surface is provided by removing the drive force on sheet 105 and lifting it slightly with air pressure from blower 82. When solenoid 94 disengages, valve 86 opens the previously closed passageway between the common inlet line 91 and air line 89. As the trail edge of sheet 105 pass over sensor 103, controller 95 activates solenoid 94 to switch chamber 79 to the acquisition state.

Turning to FIG. 3, there is shown a view of the sheet transport 70 having a plurality of different sized sheets thereon. The sheets range in size, for example, from 7×10 inches to 14×20 inches. Sheet 32 is 7×10 inches, sheet 33 is 8.5×11 inches, sheet 34 is 11×17 inches, and sheet 35 is 14×20 inches. Sensors 100, 101, 102, and 103 are arranged along the length of transport 70 so as to conform to the boundaries of chambers 77, 78, and 79. Specifically, sensors 100 and 101 identify the location chamber of 77. Likewise, sensors 101 and 102 identify chamber 78, and the sensor pair 102 and 103 identify chamber 79. Signals generated by sensors 100, 101, 102 ,103, and encoder 99 detect the sheet length and it's position as hereinbefore discussed with reference to FIG. 2. They cause controller 95 (FIG. 2) to appropriately time valves 84, 85, and 86 (FIG. 2) to switch between the acquisition and levitation states via solenoids 92, 93, and 94 (FIG. 2).

An exemplary timing diagram for sensors 100, 101, 102, 103, and encoder 99 is shown in FIG. 4. Referring to FIG. 4, pulse 43 forms a timing gate under which pulses 46 are counted at controller 95 (FIG. 2). When the lead edge of a sheet arrives at the transport, it's lead edge triggers sensor 100 to instantaneously change states as indicated by a rising (upward-going) edge 44. The transition of edge 44 signals controller 95 (FIG. 2) to begin counting pulses that are sent to the controller by encoder 99. As the sheet continues to pass over sensor 100, pulse 43 remains in a steady-state condition 47 wherein, the pulses 46 are counted. When the sheet's trailing edge arrives at the transport, it triggers sensor 100 to instantaneously change states again as indicated by a falling (downward-going) edge 45. Edge 45 signals the controller to cease counting pulses 46. The period of pulse 43 is indicative of the time the sheet is under the control of the operational mode of chamber 77.

Continuing with FIG. 4, when the trailing edge 45 of pulse 43 goes low, the sheet's leading edge triggers sensor 101. Sensor 101, in turn changes states, as indicated by a rising edge 28 on pulse 27. Pulse 27 remains in a steady-state condition 30 while the sheet is under the influence of chamber 78. When the trailing edge of the sheet passes over sensor 101, it triggers sensor 101 to change again, as indicated by a falling edge 29. Edge 29 signals then end of the control of chamber 78. At the same time, the sheet's leading edge triggers sensor 102 and generates a rising edge 17 on pulse 15. Pulse 15 remains in a steady state condition 21 to control movement of the sheet over chamber 79. Movement of the sheet is controlled by chamber 79 until it's trailing edge crosses sensor 102 to generate a falling edge 19. Thereafter, the sheet's leading edge triggers sensor 103 and generates a rising edge 39 on pulse 25. The sheet is deskewed and side registered while pulse 25 is in a steady state condition 49 between the rising edge 39 and a trailing edge 41.

One skilled in the art will appreciate that the timing diagram of FIG. 4 is for one specific sheet size. Sheets comprising many different sizes may be moved by the transport wherein, the timing diagram changes accordingly for each sheet type moved. In FIG. 4, pulses 43, 27, 15 and 25 are shown to propagate sequentially on a common falling and rising edge (pulse 27, for example, occurs immediately after pulse 43 at edge 45 and edge 28). However, when a longer length sheet moves over the transport, pulses 43, 27, 15, and 25 may overlap in accordance it's length.

In recapitulation, the present invention is directed to a sheet transport having two modes operation: acquisition and levitation. When the transport is in the acquisition mode, it attracts the sheet thereto to facilitate movement therewith. Conversely, when the transport is in the levitation mode, it supports the sheet, at least partially, to reduce the frictional force exerted on the sheet by the transport facilitating alignment of the sheet.

It is, therefore, evident that there has been provided, in accordance with the present invention, an sheet transport that fully satisfies the aims and advantages of the invention as hereinabove set forth. While the invention has been described in conjunction with a preferred embodiment thereof, it is evident that many alternatives, modifications, and variations may be apparent to those skilled in the art. Accordingly, it is intended to embrace all such alternatives, modifications, and variations which are within the spirit and broad scope of the appended claims.

I claim:

1. A printing machine of the type having a sheet advancing to a transfer station for receiving a visible image from a recording medium, wherein the improvement includes:

a transport for advancing the sheet to the transfer station, said transport having the sheet releasably secured thereto in a first mode of operation, and, in a second mode of operation, reducing the frictional force between the sheet and said transport to permit relative movement therebetween; and a controller, in communication with said transport, to select the mode of operation of said transport; and means for sensing the sheet advancing on said transport at selected positions, said controller being responsive to said sensing means for switching said transport between the first mode of operation and the second mode of operation.

2. A printing machine according to claim 1, further including means for aligning the sheet in the second mode of operation.

3. A printing machine according to claim 2, wherein said transport includes:

a moving belt; and acquiring and supporting means, operatively associated with said belt, for acquiring and releasably securing the sheet to said belt in the first mode of operation, and, in the second mode of operation, partially supporting the sheet to reduce the frictional force between the sheet and said belt, said acquiring and supporting means being responsive to said controller for switching between the first mode of operation and the second mode of operation.

4. A printing machine according to claim 3, wherein said acquiring and supporting means includes:

a blower system; and a conduit system coupling selected regions of said belt to said blower system, said blower system being regulated by said controller to reduce the air pressure between the sheet and said belt in the first mode of operation to attract and releasably secure the sheet to said belt at selected regions thereof, said controller regulating said blower system to increase the air pressure between said belt and the sheet in the second mode of operation to partially support the sheet reducing the frictional force between the sheet and said belt at selected regions of said belt to facilitate alignment of the sheet.

5. A printing machine according to claim 4, wherein said controller includes:

a valve associated with said conduit; and a solenoid coupled to said valve, said solenoid being regulated by said sensing means to move said valve to one position so that said blower system increases the air flow to selected portions of said belt in the first mode of operation and to another position to decrease the air flow to selected portions of said belt in the second mode of operation.

6. A printing machine according to claim 5, wherein said sensing means actuates said solenoid to move said valve between positions in response to the sheet being positioned at selected locations.

* * * * *